US008318260B2

(12) United States Patent
Kim et al.

(10) Patent No.: US 8,318,260 B2
(45) Date of Patent: Nov. 27, 2012

(54) METHOD FOR ELECTROLESS DEPOSITION OF NANO METALLIC SILVER AND REFLECTOR OF HIGH REFLECTANCE DEPOSITED BY NANO METALLIC SILVER USING THE SAME

(75) Inventors: Si Doo Kim, Gyeonggi-do (KR); Seong Uk Lee, Gyeongsangbuk-do (KR); Jae Youn Hwang, Gyeongsangbuk-do (KR); Shi Surk Kim, Chungcheongnam-do (KR)

(73) Assignee: Nano CMS Co., Ltd (KR)

( * ) Notice: Subject to any disclaimer, the term of this patent is extended or adjusted under 35 U.S.C. 154(b) by 192 days.

(21) Appl. No.: 12/648,780

(22) Filed: Dec. 29, 2009

(65) Prior Publication Data

US 2010/0291309 A1 Nov. 18, 2010

(30) Foreign Application Priority Data

May 15, 2009 (KR) ..... 10-2009-0042676
Sep. 28, 2009 (KR) ..... 10-2009-0091500

(51) Int. Cl.
*B05D 1/02* (2006.01)

(52) U.S. Cl. ..... 427/437; 427/421.1; 427/443.1; 347/95

(58) Field of Classification Search ..... 427/421.1, 427/437, 443.1; 347/95
See application file for complete search history.

(56) References Cited

U.S. PATENT DOCUMENTS

| | | | | |
|---|---|---|---|---|
| 3,826,726 | A * | 7/1974 | Phillipp et al. | 204/157.44 |
| 4,072,772 | A * | 2/1978 | Franz | 427/164 |
| 6,224,983 | B1 * | 5/2001 | Sodervall et al. | 428/461 |
| 6,398,854 | B1 * | 6/2002 | Aonuma | 106/1.19 |
| 2001/0055704 | A1 * | 12/2001 | Hosokura et al. | 428/699 |
| 2005/0095365 | A1 * | 5/2005 | Acum et al. | 427/421.1 |
| 2005/0174407 | A1 * | 8/2005 | Johnson et al. | 347/95 |
| 2008/0096010 | A1 * | 4/2008 | Scheler et al. | 428/332 |

* cited by examiner

*Primary Examiner* — Timothy Meeks
*Assistant Examiner* — Nathan T Leong
(74) *Attorney, Agent, or Firm* — Rodman & Rodman

(57) ABSTRACT

The present invention relates to an electroless deposition of metallic silver on various plates. More particularly, in the present invention, by spraying a silver solution including ionic silver to be reduced into metallic silver and a reducing solution a reducing agent for reducing the silver solution at the same time to a predetermined region above a substrate, metallic silver particles having a diameter less than 30 Å are formed, and a silver layer is formed by a deposition of the nano-sized metallic silver.

Since the silver layer includes nano-sized silver particles having a diameter less than 3 nm, a reflector having a high density, that is, surface roughness, can be manufactured. The reflector has a considerably excellent reflectance.

16 Claims, 5 Drawing Sheets

- 3.47nm: PV-Peak-to-Valley
- 0.63nm:RMS-Root-mean-square
- 0.51nm:Ra-Center line average

METHOD FOR ELECTROLESS DEPOSITION OF NANO METALLIC SILVER AND REFLECTOR OF HIGH REFLECTANCE DEPOSITED BY NANO METALLIC SILVER USING THE SAME

CROSS-REFERENCE TO RELATED PATENT APPLICATION

This application claims priority to and the benefit of Korean Patent Applications No. 10-2009-0042676 filed on May 15, 2009 and No. 10-2009-0091500 filed on Sep. 28, 2009, in the Korean Intellectual Property Office, the entire content of which is incorporated herein by reference.

BACKGROUND OF THE INVENTION (a) Field of the Invention

The present invention relates to an electroless deposition of nano metallic silver. Specifically, the present invention relates to a method for an electroless deposition of silver on a non-conductive surface to have a good density, and a plate having the deposited metallic silver by the method. More particularly, the present invention provides a reflector used for a solar reflector or an optic reflector that the high reflectance is necessary.

(b) Description of the Related Art

Conventionally, methods for applying metallic luster to vehicles and components for electric home appliances can be classified into two methods, that is, a wet method and a dry method. First, a chromium plating method is generally used as the wet method, and a vacuum deposition method is generally used as the dry method. However, in the chromium plating method, a toxic wastewater is generated by hexavalent chromium. In the vacuum deposition method, a producibility is low due to a high price of investment in plant and equipment and a limitation of an processing amount according to a size of the equipment.

Meanwhile, a reflector such as a mirror generally has a thin reflective metal layer coated on a surface of a glass substrate. The metal layer directly coated on the glass substrate is conventionally a silver layer. However, another metal layer such as a copper layer may be employed. When the silver layer is used as a main reflective layer, in order to suppress a corrosion of the silver layer, a copper layer is formed as a protection layer for protecting the silver layer. In addition, so as to improve an anti-corrosion property and an abrasion resistance property, a paint layer may be formed on the silver layer or the copper layer.

Here, U.S. Pat. No. 4,737,188 discloses a conventional method for forming the silver layer used as the reflection layer. That is, a mixing solution that ammoniacal silver nitrate and a reducing agent containing a strong alkali are mixed is sprayed to a sensitized glass surface, and thus the silver layer is deposited on the glass.

However, if the silver layer is formed by the above conventional plating method, there are drawbacks that a reflectance is not high (about 80%) due to a low density of the silver layer and the light is leaked out. In addition, there is a serious problem that the reflectance is drastically reduced when the reflection substrate is exposed in the outer condition.

Particularly, in a large-scale reflector used for solar thermal power generation, if the reflectance is increased by only 1%, an operation period of a solar thermal power generation can be increased to twenty years. Also, an operation rate by reflectance (that is, an energy conversion rate) can be increased, thereby achieving an effect of energy generation. Thus, the reflector having a increased reflectance by only 1% is constantly necessary.

Meanwhile, Korean Patent No. 10-0766715 (Electroless Silver Plating Using Amine) relates to an electroless silver plating method generating a silver thin film on a substrate by using an electroless plating solution including silver ion and a reducing agent. Through controlling a relative concentration between the silver ion and amine, a size of silver particles forming the silver thin film can be freely controlled from several tens nanometers to several tens micrometers, and a thickness of the silver thin film formed on the substrate can be controlled. The obtained specimen has a density (surface roughness) less than 25 μm. In the density, the silver thin film may have properties in optics and luster to some degree; however, does not have a high reflectance. Furthermore, the contents related to a reflectance is not mentioned in the Korean Patent.

Japanese Laid-Open Patent Publication No. 2001-46958 (Formation of Coating Film Having Metallic Luster) relates to a method for forming a coating film having a metallic luster on a surface of a plastic molding for automobiles or domestic appliances. This discloses a plating method using a spray process having two nozzles simultaneously spraying silver nitrate and a reducing agent. This relates to a wet coating method for providing a metallic lusted on the plastic molding, and does not relate to a reflector having a high reflectance.

SUMMARY OF THE INVENTION

The present invention has been made in an effort to solve the above problem. The present invention is for providing a method for an electroless deposition of metallic silver on various substrates. The method does not an electroless plating process using a dip method. In the method according to the present invention, by spraying a silver solution including ionic silver to be reduced into metallic silver and a reducing solution a reducing agent for reducing the silver solution at the same time to a predetermined region above a substrate, metallic silver particles having a diameter less than 30 Å are formed, and a silver layer is formed by a deposition of the nano-sized metallic silver. And, the silver layer having the nano-sized metallic silver and having a thickness more than about 110 nm is formed on the substrate, thereby having a high reflectance.

In addition, the present invention is for providing a plate having the deposited nano-sized metallic silver as a reflector having a high density and an considerably excellent reflectance.

To achieve the above object, an embodiment of the present invention provides a method for an electroless deposition of nano metallic silver. The method includes a step of preparing a silver solution and a reducing solution, and a step of spraying the prepared silver solution and the prepared reducing solution at the same time to a predetermined region above a substrate. The silver solution includes ionic silver to be reduced into metallic silver and the reducing solution includes a reducing agent for reducing the silver solution.

Here, it is preferable that the predetermined region above the substrate is a space separated from the substrate. An angle between the substrate and each of the spraying directions of the silver and reducing solutions may be more than 0° and less than 90°.

Each of the silver solution and the reducing solution may have a temperature of 20° C. to 35° C. The silver solution and the reducing solution may be sprayed in a ratio of 1 to 2 equivalents of the reducing agent based on 1 equivalent of the ionic silver with a speed of 100 ml/minute to 300 ml/minute by an air pressure of 2 kg/cm$^2$ to 7 kg/cm$^2$.

The silver solution may further include another ionic metal except for the ionic silver. The another ionic metal may be ionic aluminum.

The step of spraying the silver solution and the reducing solution may further include a step of heat-treating the silver solution including the another ionic metal for 0.5 to 2 hours at a temperature of 20° C. to 60° C. The step of spraying the silver solution and the reducing solution may further include a step of irradiating a neutron to the heat-treated silver solution.

The substrate may be a glass substrate or a quartz substrate.

Meanwhile, another embodiment of the present invention provides a plate including a silver layer having a nano-sized metallic silver deposited by the above method.

The nano-sized metallic silver may have a diameter of 2 Å to 30 Å. The silver layer may have a thickness of 110 nm to 150 nm.

According to the present invention, the present invention provides a method for an electroless deposition of metallic silver on various ceramic substrates such as glass substrate and a quartz substrate. Specifically, the method is useful to applications where a high reflectance is necessary, such as, mirror. For example, by spraying a silver solution including ionic silver to be reduced into metallic silver and a reducing solution a reducing agent for reducing the silver solution at the same time to a predetermined region above a substrate (a glass substrate or quartz substrate), metallic silver particles having a diameter less than 30 Å are formed, and a silver layer is formed with a thickness of about 110 m by a deposition of the nano-sized metallic silver. And thus, a reflectance of a high efficiency having the deposited nano-sized metallic silver can be provided.

DETAILED DESCRIPTION OF THE EMBODIMENTS

Figure 1:
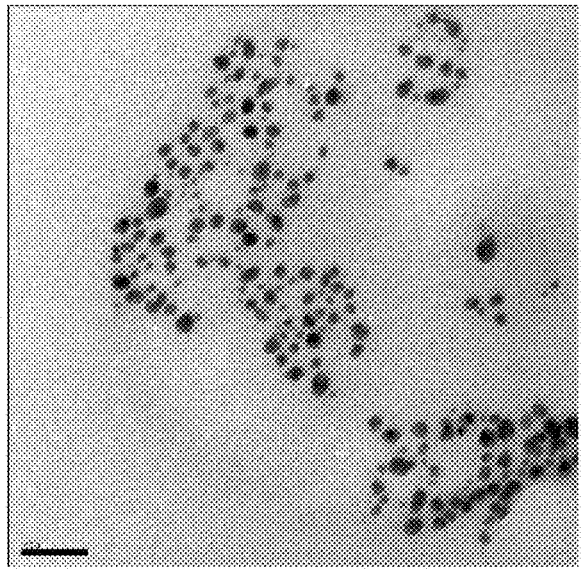
FIG. 1 is a photograph taken by an electron microscope (Model Joel JSM 2401F) for showing a silver layer having deposited nano-sized metallic silver according to the present invention.

An embodiment of the present invention will be described more fully hereinafter with reference to the accompanying drawings.

The present invention relates to a method for an electroless deposition for nano metallic silver. For this purpose, first of all, a silver solution and a reducing solution are prepared. The silver solution includes ionic silver that can be reduced into metallic silver, and the reducing solution includes a reducing agent for reducing the silver solution.

The silver solution is a source of the metallic silver for forming a silver layer. The reducing solution reduces the ionic silver in a predetermined region during a process so that the metallic silver is precipitated when the reducing solution is sprayed with the silver solution. Thus, when the silver solution and the reducing solution are sprayed at the same time to a predetermined region above a substrate in a subsequent step, the nano metallic silver is precipitated by a silver mirror reaction. The precipitated metallic silver is dropped on the substrate, and thus the silver layer is formed.

The ionic silver may include all kinds of metal compounds, salts, inclusion complexes, and coordination compounds suitable for a reflective layer. For example, the ionic silver may be Ag+. In addition, the reducing agent for reducing the silver solution may be all kinds of reducing agents suitable for reducing the ionic silver contained in the silver solution to the metallic silver.

Then, in the present embodiment, the prepared silver solution and the prepared reducing solution are sprayed at the same time to the predetermined region above the substrate. That is, when the silver solution and the reducing solution are sprayed at the same time, the sprayed silver solution and reducing solution meet each other at the predetermined region above the substrate. In order words, when the silver solution and the reducing solution are simultaneously spayed, the sprayed silver solution and the sprayed reducing solution are not sprayed to the different regions above the substrate. Thus, the sprayed silver solution and the sprayed reducing solution meet and generate the silver mirror reaction in the midair. For example, the predetermined region above the substrate is preferably a space separated from the substrate.

In the conventional spraying apparatus, a spraying nozzle is generally vertical to the substrate. Thus, even though the silver solution and the reducing solution are simultaneously sprayed, it is forced to separately spraying the silver solution and the reducing solution to the different regions of the substrate, respectively. Accordingly, in the conventional spraying apparatus, after one solution of the silver solution and the reducing solution is deposed to the substrate, another solution is deposited to the substrate. Thus, the silver mirror reaction is generated on the surface of the substrate. On the other hand, in the present embodiment, the metallic silver is precipitated at the predetermined region spaced from the substrate.

For this purpose, an angle between the substrate and a nozzle spraying each of the silver and reducing solutions is preferably more than 0° and less than 90° in the spraying step. More preferably, the angle is about 45°.

In the manner, since the silver mirror reaction is generated at the predetermined region above the substrate (preferably, the predetermined space separated from the substrate), fine metallic silver particles can be formed, compared with the conventional method. The fine metallic silver particles increase a density of the formed silver layer, and thereby enhancing the reflectance.

The present inventors carried out lots of experiments and several years of studies, and find that nano-sized particles (preferably, silver particles of having a diameter of 2 to 30 Å) can be obtained only in a specific conditions, and thus achieve the present embodiment. In the specific condition, each of the silver solution and the reducing solution has a temperature of 20° C. to 35° C. Also, the silver solution and the reducing solution are sprayed in a ratio of 1 to 2 equivalents of the reducing agent based on 1 equivalent of the ionic silver with a speed of 100 ml/minute to 300 ml/minute by an air pressure of 2 kg/cm$^2$ to 7 kg/cm$^2$.

On the other hand, the silver solution may further include another ionic metal except for the ionic silver. The another ionic metal may be ionic aluminum, gold, nickel. Specifically, the another ionic metal may be Ionic aluminum.

In a case that the silver solution is only consist of the ionic silver, it is preferable that 99.5 wt % of the nano silver particles are contained in the whole nano-sized particles obtained by the reduction. In a case that the silver solution includes another ionic metal, it is more preferable that 99.75 wt % of the nano silver particles are contained in the whole nano-sized particles obtained by the reduction. If the ratio of the nano silver particles is less than the above, the reflectance in a short-wavelength region may be low.

The silver solution including another ionic metal (not the ionic silver) may be prepared by several methods. For example, nano aluminum particle powders may be mixed to a first solution containing the ionic silver. Selectively, a first solution containing the ionic silver and a second solution containing nano aluminum particle powders are mixed each other. In addition, the silver solution containing a salt of silver together with a salt of aluminum may be prepared.

Accordingly, when the silver solution and the reducing solution are sprayed, in order to prevent aggregations of the ionic silver contained in the silver solution and the another ionic metal, the silver solution containing the another ionic metal may be heat-treated for 0.5 to 2 hours in a temperature of 20° C. to 60° C. Further, in the case that a thermal neutron is irradiated to the heat-treated silver solution for several minutes, the aggregations can be further decreased.

According to the above method for the electroless deposition of the nano metallic silver, a silver layer having deposited nano-sized metallic silver can be formed on the substrate. A plate according to the present embodiment may have the deposited nano-sized metallic silver.

Here, it is preferable that the nano-sized metallic silver has a diameter of 2 Å to 30 Å. If the diameter is not in the range, the reflectance and the durability may be deteriorated. Also, more preferably, the silver layer has a thickness of 110 nm to 150 nm. If the thickness is less than 110 nmm, ultraviolet rays or visible ray may pass through the silver layer. If the thickness more than 150 nm, the effect is not largely increased.

In addition, in the method for the electroless deposition of the metallic silver and the substrate deposited with the metallic silver, the substrate may be a glass substrate or a quartz substrate. As the glass substrate, a low iron glass substrate is preferable. A reflector that the nano-sized metallic silver is deposited on the glass substrate is suitable for a reflecting mirror. In this case, a clear image can be realized, compared with in the conventional reflecting mirror.

The present invention can be understood by following Examples. However, the following Examples are only for providing examples of the present invention. Thus, the present invention is not limited thereto.

EXAMPLE 1

A Method for an Electroless Deposition Using a Silver Solution Including Nano Silver First, a silver solution was prepared as follows. That is, 25.4 g of a silver nitrate was dissolved to 100 g of distilled water (pure water), and then 10% of ammonium hydroxide was added so that the solution had a pH of 10 to 11. After 2.5 g of a dispersing agent was added to the solution, pure water was added so that the entire solution had a volume of 500 ml. The prepared solution was agitated at a temperature of −2 to 4° C. The agitated solution was used for the silver solution.

In order to form a reducing solution, 15 g of hydrazine hydrate 30 ml of ethanol were dissolved to 455 ml of pure water, and a temperature of the solution was maintained in a range of 0 to 4° C. The solution was used for the reducing solution.

Next, in the state that the temperature of the solutions was maintained in a range of 20 to 35° C., the silver solution and the reducing solution were sprayed to a space apart by 1 to 10 cm away from a glass substrate (manufactured by Asahi Glass, thickness: 3.2 mm, width: 1.0 mm, length: 1.0 mm). They were sprayed in a ratio of 1 equivalent of the hydrazine hydrate based on 1 equivalent of the silver nitrate. And, an angle between the glass substrate and each of the nozzles for spraying the silver and reducing solutions was about 45°. Also, the solutions were sprayed with a speed of 100 ml/minute to 300 ml/minute by an air pressure of 2 kg/cm$^2$ to 7 kg/cm$^2$ through the nozzles.

The present inventors found that nano-sized particles (preferably, silver particles of having a diameter of 2 to 30 Å) could be obtained only in a specific conditions. The conditions relate to the air pressure, the ratio of equivalent of the hydrazine hydrate based on 1 equivalent of the silver nitrate, the temperature, and the volume of the solution. The results of the tests are shown in the following Table 1 to Table 5.

TABLE 1

| [a result depending on the air pressure] | | |
|---|---|---|
| Less than 2 kg/cm$^2$ | 2 to 5 kg/cm$^2$ | More than 5 kg/cm$^2$ |
| Non-uniform particles having diameters of 10 to 200 nm were formed. | Particles having diameters of 2 to 30 Å were formed. | No nano particles were formed. |

In the result depending on the air pressure, the nano particles having a diameter of 2 to 30 Å were formed only in the air pressure of 2 to 5 kg/cm$^2$.

TABLE 2

| [a result depending on the equivalent(s) of the hydrazine hydrate based on 1 equivalent of the silver nitrate] | | |
|---|---|---|
| Less than 1 equivalent | 1 to 2 equivalents | More than 2 equivalents |
| A thickness of the nano silver metal layer was not uniform. | A thickness of the nano silver metal layer could be easily controlled. | A nano silver metal layer was not formed. |

In the result according to the equivalent of the hydrazine hydrate based on 1 equivalent of the silver nitrate, the thickness of the nano silver metal layer was not uniform in the case that the equivalent of the hydrazine hydrate is less than 1. The nano silver metal layer was not formed in the case that the equivalent of the hydrazine hydrate is more than 2. On the other hand, the thickness of the nano silver metal layer could be easily controlled only in the case that the equivalent of the hydrazine hydrate is 1 to 2.

TABLE 3

| [a result depending on the temperature] | | |
|---|---|---|
| Less than 20° C. | 20 to 35° C. | More than 35° C. |
| Nano particles and the metal layer were not formed, and stains were formed. | Particles having diameters of 2 to 30 Å were formed. | A surface roughness was inferior because of aggregations. |

In the result depending on the temperature, in the case that the temperature is less than 20° C., the nano particles and the metal layer were not formed, and the stains were formed. In the case that the temperature was more than 35° C., the surface roughness was inferior because of the aggregations.

TABLE 4

| [a result depending on a volume of each of the solutions] | | |
|---|---|---|
| Less than 100 ml | 100 to 300 ml | More than 300 ml |
| A thickness of the nano silver metal layer could not be controlled. | A thickness of the layer could be easily controlled. | A thickness of the nano silver metal layer could not be controlled. |

In the result depending on the volume of each of the solutions, the thickness of the nano silver metal layer could not be controlled in the case that the volume was less than 100 ml and the case that the volume was more than 300 ml. In the case that the volume 100 to 300 ml, the thickness of the layer could be easily controlled.

TABLE 5

| [a thickness of the nano silver metal layer depending on the spraying time in the state that the volume of each of the solutions was 100 to 300 ml] | | | | |
|---|---|---|---|---|
| 30 seconds | 45 seconds | 50 seconds | 60 seconds | 90 seconds |
| 50 nm | 70 nm | 90 to 100 nm | 110 nm | 150 nm |

In the state that the volume was 100 to 300 ml, the solutions were sprayed for 30 seconds, 45 seconds, 50 seconds, 60 seconds, and 90 seconds, respectively. Thus, each of formed nano silver metal layers had a different thickness each other.

According to the above condition, the silver solution and the reducing solution were mixed to the space above the glass substrate, and the ionic silver contained in the silver solution was reduced, thereby forming the silver particle having a diameter of 2 to 30 Å. The nano-sized silver particles were deposited on the glass substrate (refer to FIG. 1), and thus a silver layer having a thickness of 5 nm~1 μm was formed. Here, the thickness of the silver layer could be varied depending on a spraying amount and a spraying time of the silver solution and reducing solution, and the volume of the reducing agent. In the embodiment, the silver layers, each having a thickness of 50, 70, 100, 120, 130, and 150 nm were manufactured so as to form a plate having each of the silver layer.

Next, the plates were cleaned by using pure water in order to remove non-reacted materials.

The nano silver particles of the manufactured plate were observed by an electron microscope (Model Joel JSM 2401F).

EXAMPLE 2

A Method for an Electroless Deposition Using a Silver Solution Including Nano Silver and Aluminum First, a preliminary silver solution including ionic silver was formed through the same method as in Example 1.

In addition, an aluminum solution was separately formed by dissolving 0.045 g of aluminum nitrate to 30 g of pure water. The aluminum solution was mixed with the preliminary silver solution to prepare a silver solution containing the ionic silver and the ionic aluminum.

And, 500 ml of a reducing solution was prepared by mixing 8% of d+glucose, 2% of ethanol, and 3% of caustic soda as a reducing agent with pure water.

Next, in the state that the temperature was maintained in a range of 20 to 35° C., the silver solution and the reducing solution were sprayed to a space apart by 1 to 30 cm away from a glass substrate (manufactured by Asahi Glass, a flat glass, thickness: 3.2 mm, width: 1.0 mm, length: 1.0 mm). They were sprayed in a ratio of 2 equivalents of the d+glucose based on 1 equivalent of the silver nitrate. And, an angle between the glass substrate and each of the nozzles for spraying the silver and reducing solutions was about 45°. Also, the solutions were sprayed with a speed of 100 mL/minute to 300 ml/minute by an air pressure of 2 kg/cm$^2$ to 7 kg/cm$^2$ through the nozzles.

According to the above condition, the silver solution and the reducing solution were mixed to the space above the glass substrate, and the ionic silver (including the ionic aluminum) contained in the silver solution was reduced, thereby forming the silver particle (including the aluminum particle) having a diameter of 2 to 30 Å. The nano-sized silver particles (including the aluminum particles) were deposited on the glass substrate (refer to FIG. 1), and thus a silver layer having a thickness of 5 nm~1 μm was formed. Here, the thickness of the silver layer could be varied depending on a spraying amount and a spraying time of the silver solution and reducing solution, and the volume of the reducing agent.

Next, the plates were cleaned by using pure water in order to remove non-reacted materials.

EXAMPLE 3

An Electroless Deposition of Nano Particles, Including Steps of Heat-Treating and Irradiating Neutron First, a silver solution was prepared. That is, 17 g of a silver nitrate and 0.94 g of aluminum nitrate were dissolved to 100 g of distilled water (pure water), and then 10% of ammonium hydroxide was added so that the solution had a pH of 9.5 to 10.5. After 2.5 g of a dispersing agent was added to the solution, pure water was added so that the entire solution had a volume of 500 ml. The prepared solution was agitated at a temperature of −2 to 4° C. The agitated solution was used for the silver solution containing the ionic silver and the ionic aluminum.

Here, unreacted ionic silver and ionic aluminum were removed by an ion exchange resin. In order to prevent the aggregations of the ionic silver and the ionic aluminum, the silver solution containing the ionic silver and the ionic aluminum was heat-treated for 0.5 to 2 hours at a temperature of 25 to 50° C., and the thermal neutron was irradiated to the solution for 3 minutes with $1.25\times10^9$ n/cm$^2$/sec.

A reducing solution was prepared by the same method as in Example 2.

Then, the silver solution, which contains the ionic silver and the ionic aluminum and is irradiated by the neutron, and the reducing solution were sprayed by the same method as in Example 2. Thus, the silver layer was formed on the glass substrate. Here, the thickness of the silver layer could be varied depending on a spraying amount and a spraying time of the silver solution and reducing solution, and the volume of the reducing agent.

COMPARATIVE EXAMPLES 1 to 5

A Reflector Including a Conventional Silver Layer

As Comparative Examples, reflectors were prepared as follows.

COMPARATIVE EXAMPLE 1

A reflector having a silver plating layer was prepared. The silver plating layer was formed by a wet method. In the reflector, a glass substrate, a silver plating layer formed by the wet method, a copper layer, and a plurality of a plurality of paint layers were sequentially formed. The reflector was a conventionally commercial reflector used for a solar energy.

COMPARATIVE EXAMPLE 2

A reflector where a silver plating layer is formed on an aluminum plate was prepared. The silver plating layer was formed by a dry method. 99.9% of silver was deposited on the aluminum plate by a vacuum deposition under 10-6 Torr. A thickness of the silver plating layer was 3° C. The reflector was a conventionally commercial reflector used for a solar energy.

COMPARATIVE EXAMPLE 3

A commercial plate was prepared by anodizing aluminum plate. An oxide film was formed on the surface of the aluminum plate. The reflector was a conventionally commercial reflector used for a solar energy.

COMPARATIVE EXAMPLE 4

A reflector having a protective layer formed on a front surface was prepared. It was an opposite structure of the conventional reflector used for a solar energy. By spray-coating a polyestera resin with a thickness of 20 μm on the silver layer manufactured by Example 3, the reflector has a structure of a polymer-coated layer/nano silver layer/glass substrate. The reflector was experimented in the situation that the polymer-coated layer was used as a front surface.

Comparative Example 5

A conventional mirror where a silver layer and a copper layer are stacked on a glass substrate was prepared.

EXPERIMENTAL EXAMPLE 1

A Test Measuring a Reflectance

Figure 2:
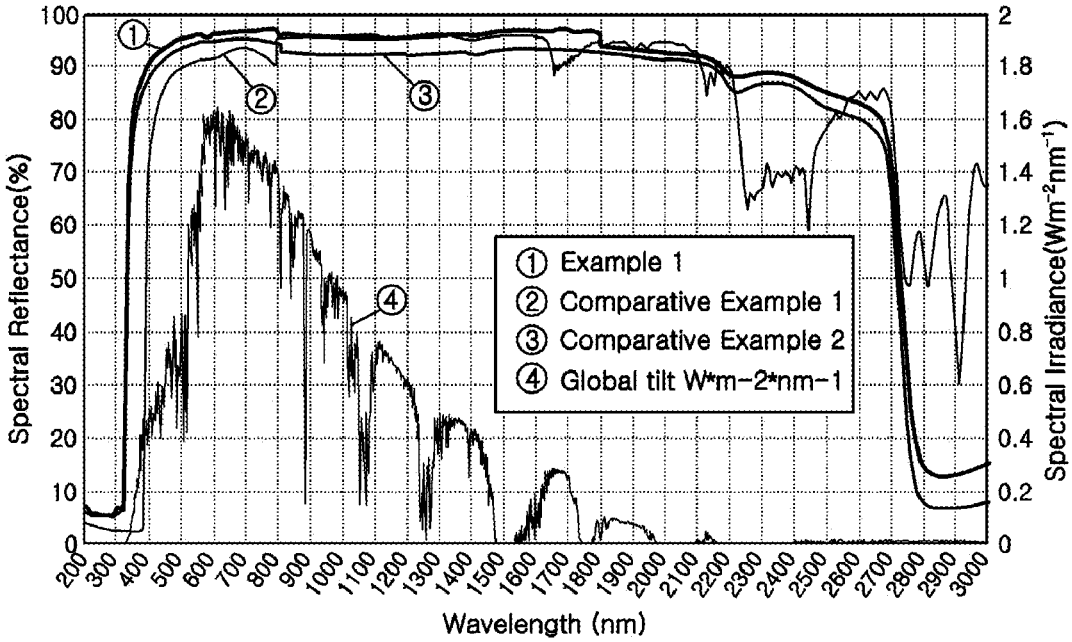
FIG. 2 is a graph of the reflectance in Example 1 and Comparative Examples 1 and 2.
Figure 3:
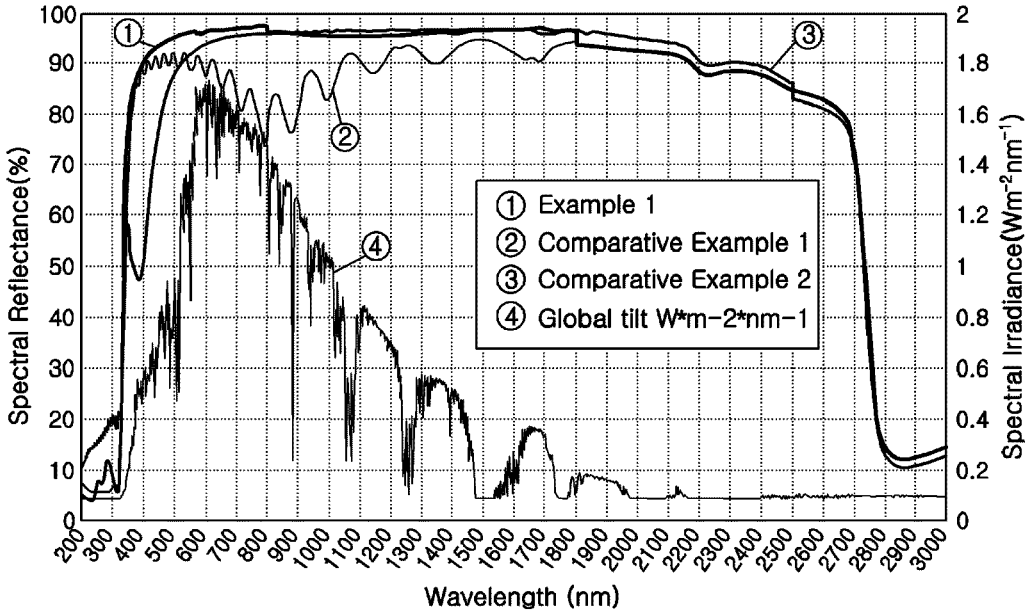
FIG. 3 is a graph of the reflectance in Example 1 and Comparative Examples 3 and 4.

The reflectance of each of the reflectors manufactured by Examples and Comparative Examples was measured by using Model Shimadzu UV-3100PC. First, the reflectance of the plate (reflector), which had the silver layer with the thickness of 110 nm and was manufactured by Example 1, and the reflectance of the reflectors manufactured by Comparative Examples 1 and 2 were measured. The results are shown in FIG. 2. In FIG. 2, ④, represents a spectrum of a general solar energy. As shown in FIG. 2, compared with in Example 1, the reflectance of visible rays and infrared rays (about 380 to about 1,000 nm) was deteriorated in Comparative Examples 1 and 2. Particularly, in Comparative Examples 1 and 2, the reflection was not efficiently generated in a short wavelength region (350-400 nm), and thus, the reflection efficiency is low The reflectance of the plate, which had the silver layer with the thickness of 110 nm and was manufactured by Example 1, and the reflectance of the reflectors manufactured by Comparative Examples 3 and 4 were measured. The results are shown in FIG. 3. As shown in FIG. 3, compared with in Example 1, the reflectance of visible rays (about 380 to about 780 nm) was greatly deteriorated in Comparative Examples 3 and 4.

Figure 4:
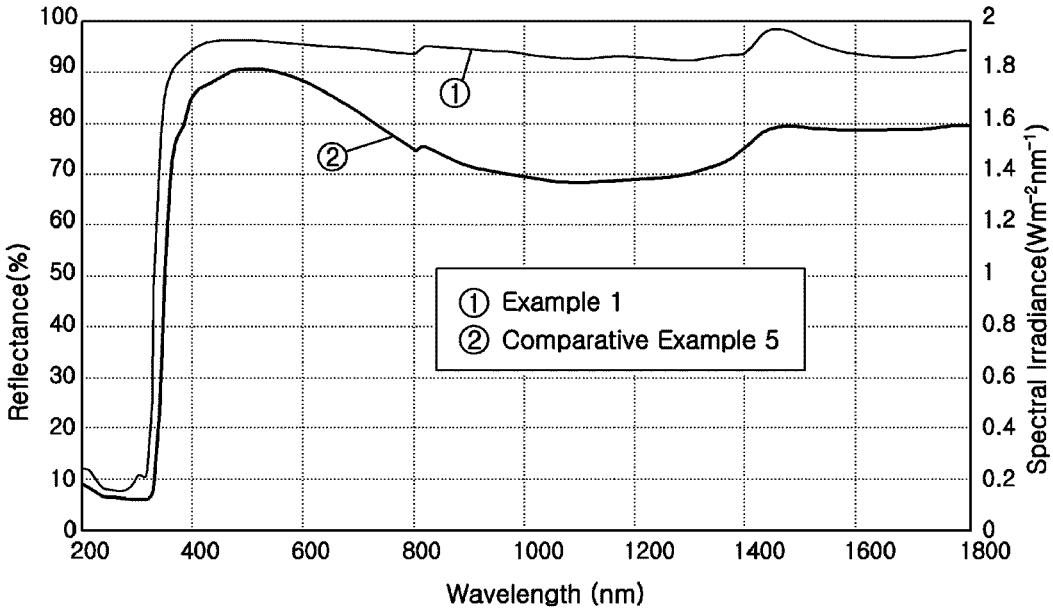
FIG. 4 is a graph of the reflectance in Example 1 and Comparative Example 5.

In addition, The reflectance of the plate, which had the silver layer with the thickness of 110 nm and was manufactured by Example 1, and the reflectance of the reflector manufactured by Comparative Example 5 were measured. The results are shown in FIG. 4. As shown in FIG. 4, the reflectance of Example 1 was high in entire region.

EXPERIMENTAL EXAMPLE 2

A Test Measuring a Density

The density of the reflectors manufactured by Examples and Comparative Examples was measured through an optical interference method using Model Zaigo NV6300.

Figure 5:
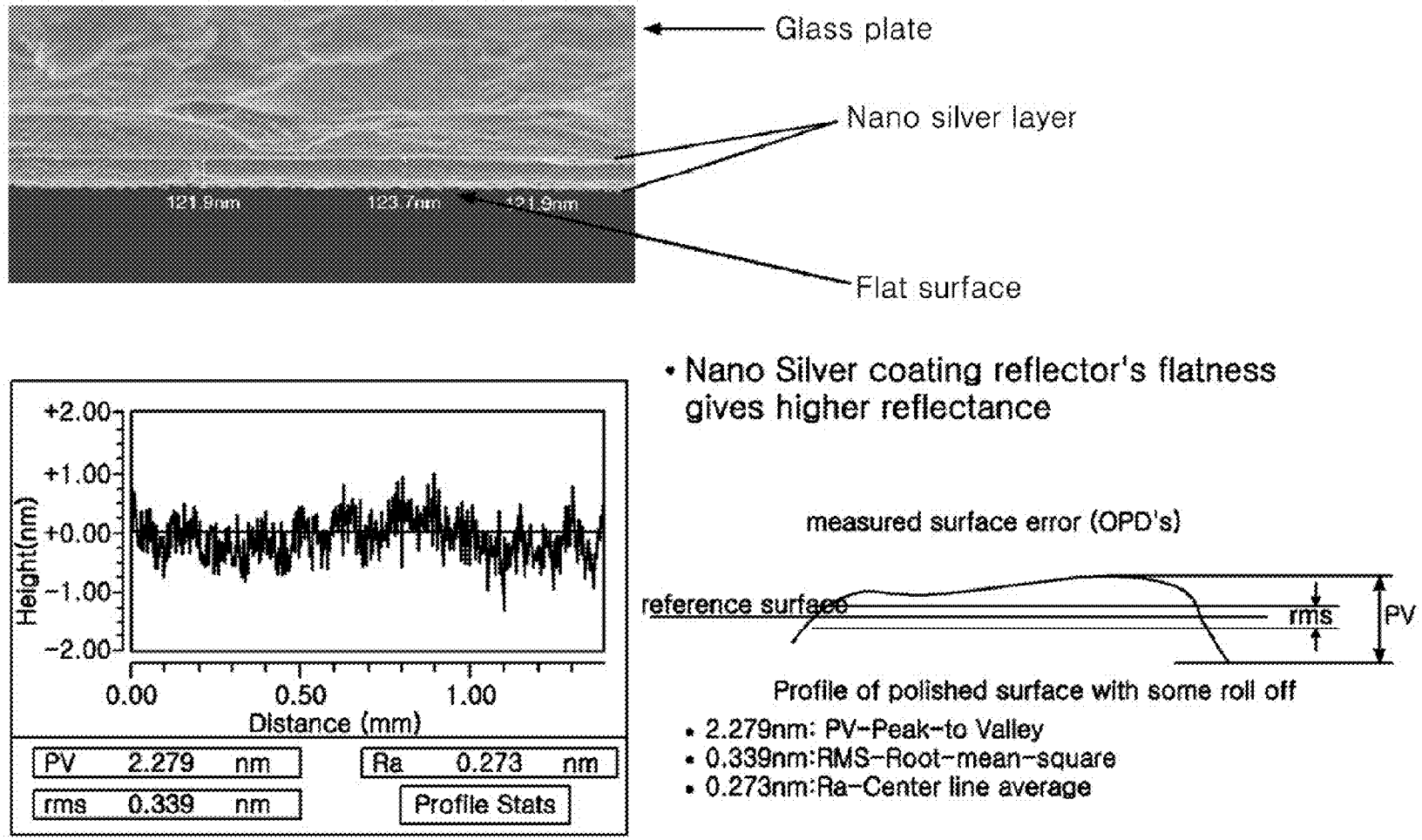
FIG. 5 is a microscope photograph showing a cross-section and a density of a layer in the reflector according to Example 1 of the present invention

That is, as shown in FIG. 5, in the reflectance of the plate, which had the silver layer with the thickness of 110 nm and was manufactured by Example 1, a surface of the silver layer was flat and dense. The value of density measured by using Model Zaigo NV6300 was PV 2.279 Ra 0.273. That is, the density was superior.

Figure 6:
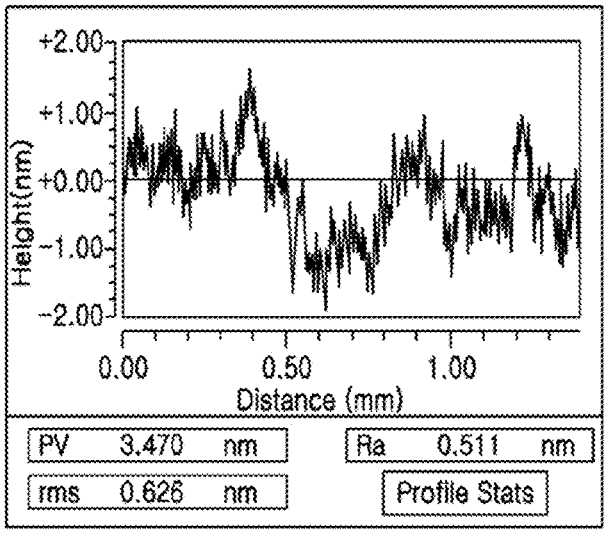
FIG. 6 is a graph photograph showing a density of a layer in the reflector according to conventional Comparative Example 2.

On the other hand, as shown in FIG. 6, the reflectance plate, which had the silver layer manufactured by the vacuum deposition in Comparative Example 2, the value was PV 3.47 Ra 0.51. Thus, it can be seen that the reflector according to the present invention had a considerably excellent density.

Figure 7:
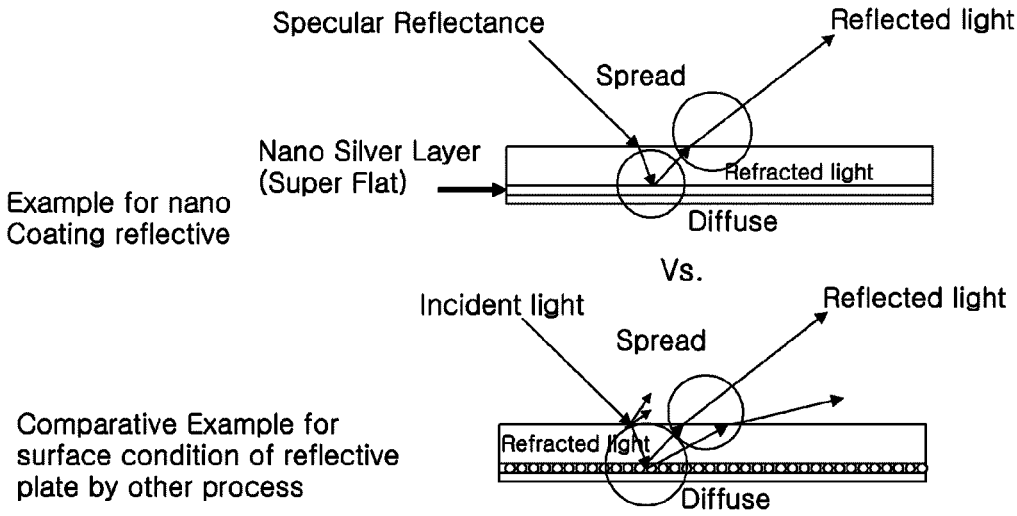
FIG. 7 is a schematic view showing a reflection efficiency according to a density.

FIG. 7 is a schematic view showing a reflection efficiency according to a density. The reflector of the present embodiment had an excellent density, and thus had a high reflectance.

EXPERIMENTAL EXAMPLE 3

A Test Measuring Reflectance Depending on the Thickness of the Silver Layer

With respect to the reflectors having the silver layers formed by the Example 1, a degree of a light leakage depending on the thickness was tested.

That is, in the reflection layers manufactured according to the Example 1, the silver layers had a thickness of 50 nm, 70 nm, 100 nm, 110 nm and 150 nm, respectively. The light leakage was measured by measuring the reflectance through Model Shimadzu UV-3100PC.

Figure 8:
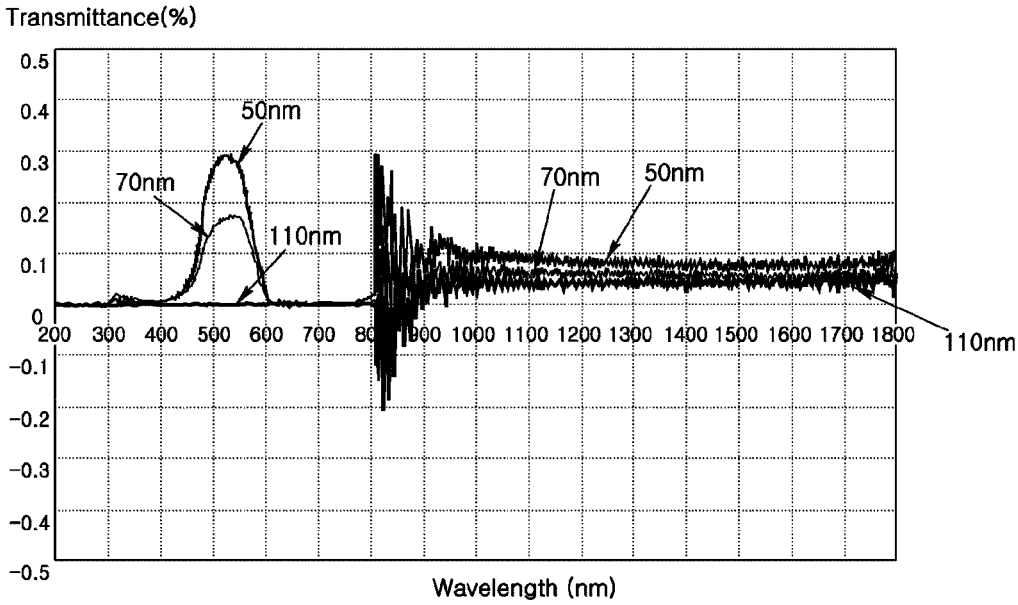
FIG. 8 is a graph showing a light transmission of silver layers according to Example 1 of the present invention, depending on a thickness of each of the silver layer.

The result was shown in FIG. 8 and Table 6. When the silver layer had thickness less than 100 nm, the light was leaked. Considering an amount of generated infrared rays (the degree of the light leakage), it was most preferable that the silver layer had a thickness of 110 nm or more than 110 nm.

TABLE 6

[A reflectance depending on the thickness of the silver layer]

| A thickness of a silver layer (nm) | The light leakage by an analysis (%) | | |
|---|---|---|---|
| | ultraviolet rays | visible ray | Infrared rays |
| 50 | Yes | Yes | Yes |
| 70 | Yes | Yes | Yes |
| 100 | Yes | No | Amount: 0.06 |
| 110 | Yes | No | Amount: 0.03 |
| 12 | No | No | Amount: 0.03 |
| 150 | No | No | Amount: 0.03 |

EXPERIMENTAL EXAMPLE 4

A Test Measuring a Reflectance of a Reflector Having a Silver Layer with a Thickness of 110 nm With respect to the reflectors having the silver layers formed by Example 1 and Comparative Examples 1 to 5, the reflectance was measured in order to compare qualities.

That Is, the silver layer of the reflector according to Example 1, had a thickness more than 110 nm, and the reflectance was measured by using Model Perkin Elmer 1050.

The result was shown in FIGS. 2, 3, and 4, the following Table 7.

| | kind of a reflector | material of a substrate | material of a reflection layer | initial reflectance at 550 nm [%] | total reflectance | reflection at short wave-length |
|---|---|---|---|---|---|---|
| Example 1 | a specimen of Example 1 | glass | silver | 96.4 | 95 | |
| Comparative Example 1 | commercial reflector | glass | silver | 93.5 | 90 | no reflection |
| Comparative Example 2 | used for a solar energy | aluminum | silver | 91.5 | 91 | |
| Comparative Example 3 | | aluminum | Anodizing | 89.0 | 87 | |
| Comparative Example 4 | a reflector having a protective layer formed on a front surface | glass | silver | 87.0 | 89 | no reflection |
| Comparative Example 5 | a conventional mirror | glass | silver | 87.0 | 80 | no reflection |

EXPERIMENTAL EXAMPLE 5

A Test Measuring a Reflectance Depending on The Time Elapse

With respect to the reflector according to Examples 1 and 2, and Comparative Example 1, an initial reflectance and a time-elapse reflectance in the visible rays were measured by using Model Shimadzu UV-3100PC.

The test for the reflectance depending the time elapse was in order to know whether the flexibility was continuously maintained in the different outer conditions, such as day and night, a high temperature, in the cold, in the high humidity, and in the wind. The durability was valued by measuring the reflectance of the reflector exposed to Weather-o-meter (Atlas Ci-3000 Xenon lamp, 2800 KJ/$m^2$/Hr), after 500 hours, 1000 hours, 2000 hours, and 3000 hours. The humidity was 85%, and the temperature was 60° C., The result was shown in the following Table 8. The initial reflectance of the reflector according to Example 1 and 2 is high than the initial reflectance of the reflector according to Comparative Example 1 by 3%. The time-elapse reflectance of the reflector according to Example 1 and 2 is high than the time-elapse reflectance of the reflector according to Comparative Example 1 by 3% to 4%.

TABLE 8

[an initial reflectance and a time-elapse reflectance]

| | an initial reflectance (%) | a time-elapse reflectance (%) | | | |
|---|---|---|---|---|---|
| | | 500 hours | 1,000 hours | 2,000 hours | 3,000 hours |
| Example 1 | 96.4 | 96.0 | 95.5 | 94.9 | 94.0 |
| Example 2 | 96.6 | 96.2 | 95.6 | 95.2 | 94.1 |
| Comparative Example 1 | 93.5 | 93.0 | 92.2 | 91.8 | 90.2 |

If the reflectance of the reflector in the present invention was raised by about 2%, like in the Table 7, a unit producibility per year could be improved corresponding to a degree of (an area of 2,000,000 $m^2$)×(an energy conversion rate)×(a reflectance), according to 200 MW SEGS Modeling Simulation with reference a solar thermal power station of 200 MW. Thus, the considerable cost could be reduced.

According to the present invention, by spraying a silver solution including ionic silver to be reduced into metallic silver and a reducing solution a reducing agent for reducing the silver solution at the same time to a predetermined region above a substrate, metallic silver particles having a diameter less than 30 Å are formed, and a silver layer with a thickness more than about 110 nm is formed on the substrate by a deposition of having the nano-sized metallic silver.

Also, since the silver layer has the nano-sized silver particles, a density can increase. Thus, the plate can be used for a reflector having a considerably excellent reflectance.

The reflector according to the present invention has the considerably excellent reflection efficiency compared with the conventional solar reflector. Thus, the light loss generated at a reflection of solar light can be minimized, and the reflection efficiency can be maximized. Accordingly, in a solar CPV electric generator system and a solar thermal power station using a solar energy, characteristics in an energy generation can be improved.

Thus, when the plate is used for a reflecting mirror, a clear image can be realized, compared with the conventional reflecting mirror.

While this invention has been described in connection with what is presently considered to be practical exemplary embodiments, it is to be understood that the present invention is not limited to the disclosed embodiments, but, on the contrary, is intended to cover various modifications and equivalent arrangements included within the spirit and scope of the appended claims.

What is claimed is:

1. A method for the electroless deposition of nano metallic silver on a substrate comprising steps of:

preparing a silver solution and a reducing solution, wherein the silver solution is heat treated and irradiated with neutrons and includes ionic silver to be reduced into metallic silver and the reducing solution includes a reducing agent for reducing the silver solution; and spraying the prepared silver solution and the prepared reducing solution at the same time to a predetermined region above the substrate wherein the silver solution and the reducing solution meet and react in the predetermined region above the substrate to form the metallic silver particles which are deposited as a nano-sized silver layer on the substrate and have a diameter of 2 Å to 30 Å;

wherein the silver layer has a surface roughness of less than 3 nm; and wherein the silver solution and the reducing solution are each at a temperature of 20° C. to 35° C.; and wherein the silver solution and the reducing solution are sprayed in a ratio of 1 to 2 equivalents of the reducing agent based on 1 equivalent of the ionic silver with a speed of 100 ml/minute to 300 ml/minute at an air pressure of 2 kg/$cm^2$ to 5 kg/$cm^2$.

2. The method of claim 1, wherein the substrate is glass.

3. The method of claim 1, wherein the silver solution further comprises another ionic metal except for the ionic silver.

4. The method of claim 3, wherein the other ionic metal is selected from the group consisting of aluminum, gold, and nickel.

5. The method of claim 4, wherein the another ionic metal is ionic aluminum.

6. The method of claim 5, wherein the ionic aluminum solution comprises aqueous aluminum nitrate.

7. The method of claim 6, wherein the silver-aluminum solution comprises an aqueous solution of silver nitrate, aluminum nitrate and ammonium hydroxide.

8. The method of claim 1, wherein the step of spraying the silver solution and the reducing solution further comprises a step of heat-treating the silver solution including the another ionic metal for 0.5 to 2 hours at a temperature of 20° C. to 60° C.

9. The method of claim 1, wherein the predetermined region above the substrate varies from about 1 to 30 centimeters.

10. The method of claim 1, wherein the angle between the substrate and the spraying directions of the silver solution and the reducing solution varies from greater than 0 degrees to less than 90 degrees.

11. The method of claim 10, wherein the angle is about 45 degrees.

12. The method of claim 1, wherein the nano-sized silver layer deposited on the substrate has a thickness of at least 110 nm.

13. The method of claim 12, wherein the thickness of the nano-sized silver layer varies from about 110 nm to about 150 nm.

14. The method of claim 1, wherein the substrate is quartz.

15. The method of claim 1, wherein the silver solution comprises an aqueous solution of silver nitrate and ammonium hydroxide.

16. The method of claim 1, wherein the reducing solution comprises an aqueous solution of hydrazine hydrate and ethanol.

* * * * *